United States Patent [19]

Martell et al.

[11] Patent Number: 4,785,282

[45] Date of Patent: Nov. 15, 1988

[54] PULSE CODED WARNING SYSTEM FOR RACETRACK

[76] Inventors: Richard J. Martell, 4929 Orangeport Rd., Brewerton, N.Y. 13029; Donald D. Martell, 103 Colchester Rd., Minoa, N.Y. 13116

[21] Appl. No.: 168,229

[22] Filed: Mar. 15, 1988

Related U.S. Application Data

[63] Continuation-in-part of Ser. No. 944,658, Dec. 22, 1986.

[51] Int. Cl.[4] ..... G08B 23/00

[52] U.S. Cl. ..... 340/323 R; 340/902; 340/905; 340/908; 340/696; 340/351; 272/4; 273/86 R

[58] Field of Search ..... 340/323 R, 696, 825.69, 340/825.72, 351, 356, 539, 902, 905, 906, 908; 455/39, 53, 54, 95; 272/4; 273/86 R

[56] References Cited

U.S. PATENT DOCUMENTS

| | | | |
|---|---|---|---|
| 2,442,851 | 6/1948 | Halstead | 340/905 |
| 3,233,217 | 2/1966 | Bost, Jr. | 340/902 |
| 3,532,986 | 10/1970 | Gelushia et al. | 340/902 |

*Primary Examiner*—Donnie L. Crosland
*Attorney, Agent, or Firm*—Wall and Roehrig

[57] ABSTRACT

A race condition alerting system includes a transmitter actuated by a flagman or other race official and a receiver unit in each race car. The transmitter transmits a pulse encoded signal repeatedly over about a ten second interval, with a digital code that corresponds, e.g., to a green flag or a yellow flag condition. The receiver units which are self contained receive and decode the signal and then switch on the appropriate indicator. To combat electrical engine noise, the receiver includes a noise gate and a pulse width decoder. A latching flip flop holds the appropriate indicator on until a different coded signal is transmitted. All of the race competitors receive the same visual indication substantially simultaneously.

7 Claims, 3 Drawing Sheets

PULSE CODED WARNING SYSTEM FOR RACETRACK

BACKGROUND OF THE INVENTION

This is a continuation-in-part of co-pending patent application Ser. No. 944,658, filed Dec. 22, 1986.

This invention relates to vehicle emergency warning systems, and is more particularly directed to a radio system which is used for communicating a yellow flag, i.e., caution condition, from a race official to the drivers of race cars or other racing vehicles on a closed loop race course.

In automobile racing, when a caution period is declared by a race official, a flagman (or several flagmen) will indicate this to the drivers by displaying a yellow flag. This is often supplemented by trackside caution lamps. This existing system has a number of drawbacks, which result in collisions and pileups that occur "under the yellow flag".

The existing system of flags and lights relies on a race competitor's seeing the flag or light at a time when he or she is concentrating completely on operating the race car. Because of the nature of the driving competition, it is often difficult for the drivers either to see the existing system or to react to it. One of the main pitfalls of the existing system is that, due to dust and smoke on the course, proximity to or distance from the existing system, or glare of sunlight in the eyes of the drivers, as wel as the need to concentrate on the driving, competition drivers cannot all be expected to see the caution signal at the same time. Also, because a driver and race car may often have to complete an entire loop before passing under the flagman, many competitors take advantage of the first lap of a caution period by overtaking another car and bettering their position in the race. This, of course, is highly dangerous as the race car driver will often steer into the very same wrecked car that is the reason a caution was declared.

Also, the two existing systems, flagmen and lights, are not always initiated at the exact same time, and some of the drivers will rely on one or the other, but not both. Moreover, one competitor's view may often be blocked by another competitor's race car. In either case, if a competitor reacts to the caution, a closely-following competitor may not see the caution at the same time and not react, which can eventuate in a rear end collision that is costly and extremely dangerous for both competitors. This type of collision can result in serious injury or death.

Because of accidents of this type that can occur while "under the yellow", race promoters have experienced sharply increased cost for insurance, and race fans experience considerable delays in the race due to extra "clean up".

In short, the existing caution alerting systems for motor vehicle racing lack the ability to signal a caution warning to all the competitors simultaneously, and cannot ensure that the competitors will be alerted to the caution under all race conditions.

OBJECTS AND SUMMARY OF THE INVENTION

It is an object of this invention to provide a race hazard condition alerting system which avoids the above-mentioned drawbacks of existing systems.

It is another object of this invention to provide a race hazard condition alerting system in which an alerting indicator is positioned in plain view of every competitor and will let every competitor know simultaneously when there is a caution period declared by the race official.

It is a still further object of this invention to provide such a system which has dual elements for a built-in back-up.

It is a general object of this invention to provide a race hazard condition alerting system which will eliminate the dangerous practice of "passing under the yellow".

It is yet a further object of this invention to provide a race hazard condition alerting system which alerts race vehicle drivers under all adverse conditions, i.e., when dust on a dirt course, or sunlight on dirt, asphalt, water, or air makes it impossible to see a flag or trackside light of existing systems.

It is still another object of this invention to provide a race hazard condition alerting system which is effective in both daytime and night competition.

It is yet another object of this invention to provide a reliable alerting system which will operate even in the presence of severe electrical engine noise and interference that is typical of automotive racetrack operation.

According to an aspect of this invention, the race hazard condition alerting system is well adapted for use on a closed loop race course around which a number of race cars or other racing motor vehicles proceed. A race course official monitors track conditions and communicates to the competitors when he declares a hazard condition, during which the race car drivers are to observe caution rules (i.e., "hold position", "no passing").

The system has a transmitter which is actuated by the race official and a number of receiver units each of which is disposed in a respective one of the race cars and has a visible indicator in plain view of the driver.

The transmitter transmits an RF carrier, typically about 50 MHz, which is modulated to indicate the presence (or absence) of the hazard condition. A manual switch on the transitter permits the flagman to select the signal that is transmitted so as to correspond to the observed hazard condition (i.e., green, yellow or red), and this is radiated by means of an antenna or antenna system over a range that encompasses the entire race course.

Each of the receiver units have means for mounting it in the associated race vehicle, an antenna to receive the signal transmitted by the transmitter, a demodulator to demodulate the signal carrier to produce a hazard indication, and a hazard lamp which is actuated by the hazard indication. There can be two each of green, yellow, and red lamps which are lit to indicate green, yellow and red flag conditions, in response to the flagman actuating the manual switch to the corresponding position on the transmitters. When there is a change in hazard condition, i.e., if the flagman signals a caution (yellow flag) the yellow lights will light up the receiver units in all the race cars at the same time, and these are clearly visible to all the drivers under all road conditions.

Preferably the signals are coded at the transmitter side and decoded at the receiver unit side, so a specific code can be used to light the caution lamps. This prevents stray or spurious signals or RF noise from accidentally misindicating a caution. Without appropriate signal encoding and without decoding circuitry in the receivers, the high amount of electrical noise from race vehicles would be likely to prevent effective operation.

The transmitter can be connected with an electrical supply for the trackside caution light system so that the same switch that actuates the lights in the race car receiver unit also turns on the corresponding lights in the trackside system or vice versa.

A flasher can be incorporated to cause the receiver unit lamps to flash at the option of the flagman or other race official.

The above and many other objects, features, and advantages of this invention will be more fully understood from the ensuing detailed description of a preferred embodiment, which is to be read in connection with the accompanying drawing.

DETAILED DESCRIPTION OF THE PREFERRED EMBODIMENT

Figure 1:
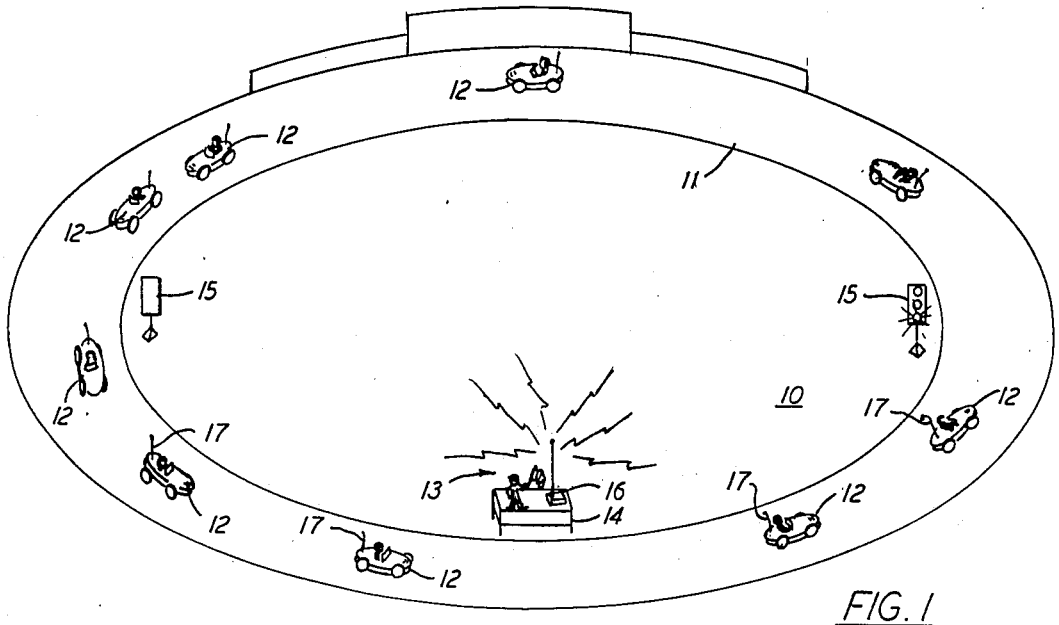
FIG. 1 is a perspective view showing a motor speedway race course at which the system of this invention is employed.

With reference to the drawing, and initialy to FIG. 1, a race course 10 is shown to consist of a closed loop track 11 around which a number of race cars 12 proceed. A flagman 13 is positioned on a platform 14 near the track 11, preferably at the start/finish line. On many tracks additional flagmen, i.e., corner men, are stationed at various positions around the track. To start the race, the flagman 13 displays a green flag, and at the end displays a checkered flag to indicate a car has finished. The flagman 13 also displays a yellow flag when a caution period has been declared, for example, in the case of a disabled race car on the track or some other hazard that must be cleared. A red flag is used when the hazard is so severe that the race must be halted.

In order to augment the flag system, many race tracks also employ a trackside caution light system 15 which can have green, yellow and red lights that are lit respectively during normal race, caution, and severe or halt conditions.

As mentioned above, it is often difficult for the competitors to see the flagman 13 or the light system 15 owing to dust, glare, an obstructing race vehicle, or other reason. Because of this it often occurs that a competitor is not alerted to the caution in time to avoid a mishap that results in damage to the race vehicle, and could result in injury or death of the competitor.

In order to minimize the chances of this happening, the race course 10 has a radio type hazard alerting system configured according to the present invention, with a transmitter 16 that is actuated by the flagman 13 in the event a caution or other race condition is declared, and receiver units 17 carried in each and every one of the competing race cars 12 which indicate clearly to the drivers that a green, yellow, or red condition is in effect, and which do so for all the race cars 12 simultaneously.

Figure 3:
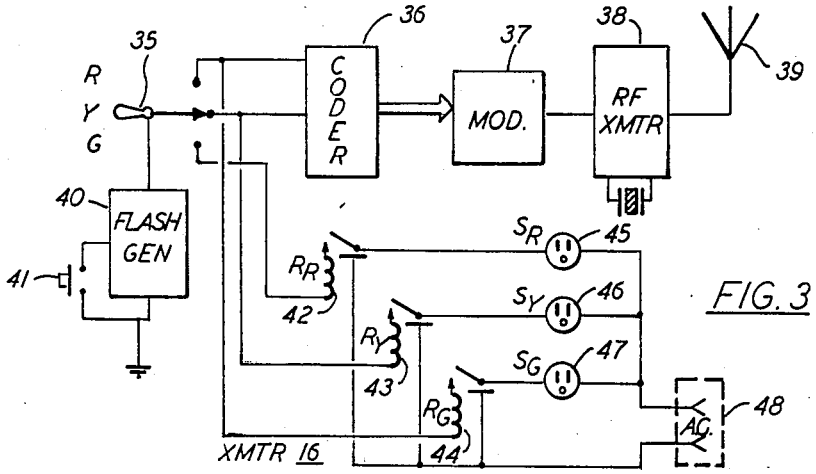
FIG. 3 is a schematic view of a transmitter according to an embodiment of this invention.
Figure 2:
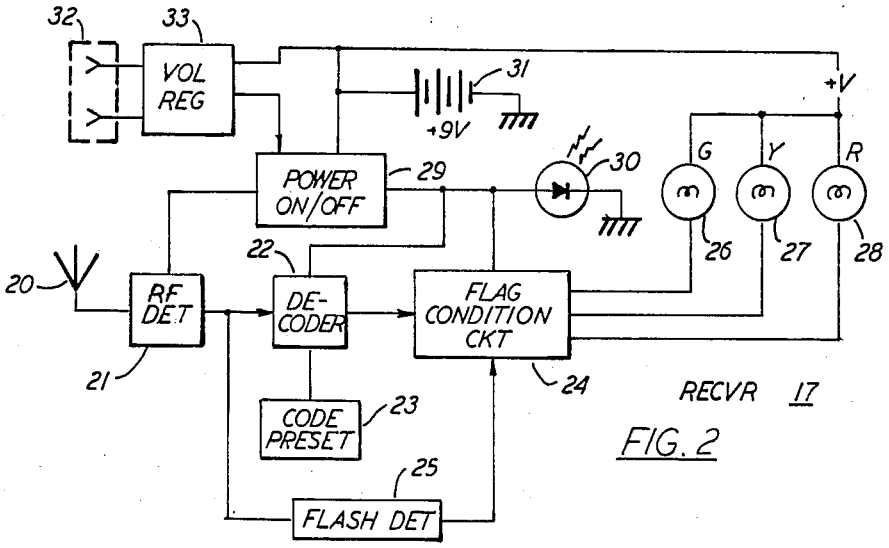
FIG. 2 is a schematic view of a receiver module according to an embodiment of this invention.

The receiver unit 17 has the basic circuitry as generally shown in FIG. 2, and the transmitter 16 is configured generally as shown in FIG. 3.

The electronics of the receiver unit 17 include an antenna 20 which picks up the modulated signal from the transmitter 16 and feeds the signal to an RF detector 21 which is followed by a decoder 22. A code pre-set selector 23 is employed to select respective codings to identify green flag, yellow flag, and red flag conditions. The decoder 22 supplies an appropriate signal to a flag condition circuit 24. A flash detector 25 is coupled between the detector 21 and the flag condition circuit 24. The flag condition circuit 24 switches on a green lamp 26, a yellow lamp 27, or a red lamp 28, as appropriate. A power supply voltage +V is furnished through a power on/off circuit 29 to the detector 21, decoder 22, and flag condition circuit 24, and this power on/off circuit 29 also feeds a power-on LED 30 which is visible when power is being actively supplied to the circuits of the receiver unit 17. The flash detector 25 causes the lamps 26, 27, and 28 to flash on and off in response to a command carried on the radio signal from the transmitter 16.

Power is supplied from a self-contained power supply, here a twelve-volt battery 31, which feeds the power on/off circuit 29 and the lamps 26–28. The vehicle electrical system can optionally supply operating voltage through a connector 32 and voltage regulator 33 to the power on/off circuit 29 and to the lamps 26–28.

The transmitter 16 has a three-way selector switch 35 which the flagman can actuate to select green, yellow, or red flag conditions as appropriate. This switch 35 has three terminals connected respectively to inputs of a coder circuit 36 which supplies coded signals, corresponding to green, red, and yellow flag senses, through a modulator 37 and an RF transmitter 38 to an antenna 39. With this system, one of the three senses, i.e., red, yellow, or green, is always being transmitted. The RF transmitter circuit 38 has a predetermined frequency which corresponds to the frequency of all of the receiver units 17 in the system. In a preferred embodiment, this frequency is nominally about 50 MHz.

A flasher generator 40 produces a flash sense which is fed into the coder 36, and this flasher generator 40 is actuated by a flasher on/off switch 41.

The terminals of the switch 35 are also connected to respective red, yellow, and green condition relays 42, 43, and 44 which respectively connect AC outlets, 45, 46, and 47 with a source of AC power 48. These outlets 45, 46, and 47 are respectively connected to the red, yellow, and green lamps of the trackside lighting system 15.

Figure 4:
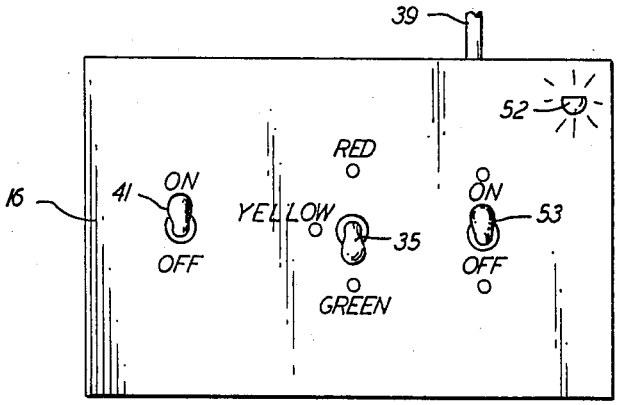
FIGS. 4 and 5 are front and rear views of a flagman's transmitter unit according to this invention.
Figure 5:
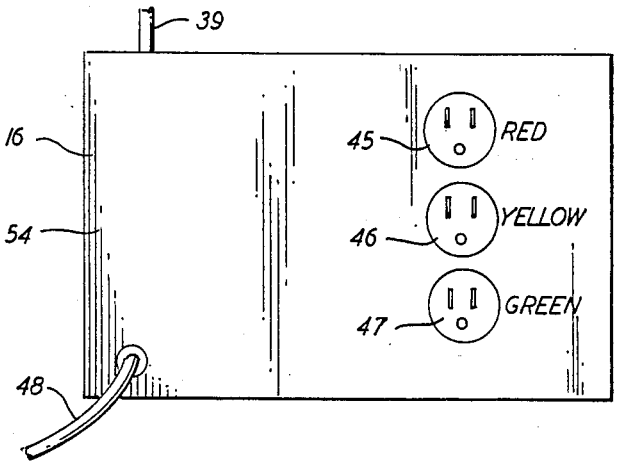

The transmitter 16 is contained within a case or housing 50 as shown generally in FIGS. 4 and 5. In the front panel 51 (FIG. 4) there are a power-on indicator pilot light, the flasher on/off switch 41, the light select switch 35, and a main power on/off switch 53. The antenna 39 is configured as a whip antenna which rises from the top of the housing 50. Optionally, the antenna can be remotely located at one or at several locations around the track 11.

On a rear panel 54 (FIG. 5) are the AC power input 48, and the AC outlets 45, 46, and 47 which feed the lamps of the trackside lighting system 15. The entire transmitter package is lightweight and rather compact, and can be disclosed in near proximity to the flagman's station on the platform 14.

Figure 6:
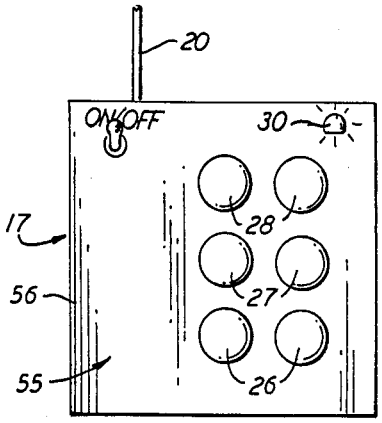
FIGS. 6 and 7 are front and rear views of a race driver's receiver unit according to this invention.
Figure 7:
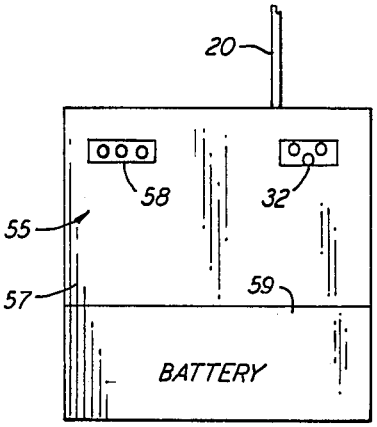

Each receiver unit 17 is disposed in a compact case or housing 55, as shown in FIGS. 6 and 7, and each receiver unit 17 is completely self-contained within the case or housing 55. On a front panel 56 (FIG. 6) are the on/off switch 29 and the system-on light 30. The red, yellow, and green lamps 26, 27, and 28 are redundantly provided; in this case there are two each of the lamps 26, 27, and 28. The antenna 20 is a short flexible whip antenna which rises from the top of the receiver unit housing 55.

On a rear panel 57 (FIG. 7) of the receiver unit housing 55 there are disposed an external lamp output connector 58, which is electrically connected to the flag condition circuit 24 in advance of the lamps 26, 27, and 28. The automotive power input connector 32 is also disposed on the rear panel 57.

At the lower part of the rear of the housing 55 is a cover 59 for a battery compartment which contains the twelve-volt battery 31.

The receiver unit 17 is rather light in weight, weighing only one or two ounces, and is dimensioned to be only about three inches in height and width and about one inch in depth. The receiver unit 17 is held in place by a quick-mounting strap (which is not specifically shown), and the strap can be of Velcro or a similar pile type releasably attaching material. The entire receiver unit 17 is removably mountable on the dash of the race car 12 so that the lamps 26–28 are always in plain view of the driver.

Preferably, the transmitter 16 and all of the receiver units 17 are obtained by the track or course operator and are distributed by the operator to the competitors prior to race time so that this will insure that all of the receiver units 17 are on the same frequency and will not interfere with other radio devices in the area.

In other possible embodiments, the receiver unit 17 can omit the lamps 26 and 28, provide a yellow caution only, or the system can operate without the flasher capability. The exact configuration would depend on the needs and local operating conditions at the particular race course 10.

The system of this invention is not confined to automobile racing, but can be employed to advantage in racing of motorboats, airplanes, motorcycles or other racing motor vehicles.

The circuitry of the transmitter 16 and the receivers 17 has been especially designed to operate reliably in a racetrack environment where there is an enormous amount of electrical noise and interference. That is, the coded signal used to change from a yellow to a green flag condition, for example, has to be discernible, and must be distinguished from electrical ignition noise.

Figure 8:
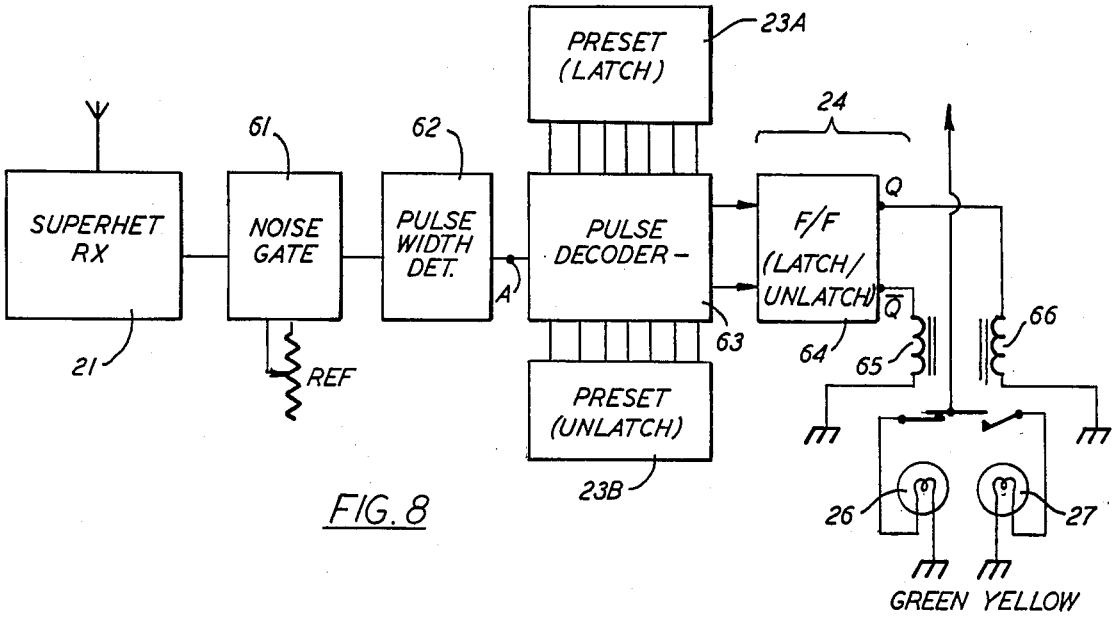
FIGS. 8 and 9 show details of the circuitry of the receiver and transmitter of FIGS. 3 and 4.

A portion of the receiver unit circuitry is illustrated in FIG. 8, and those elements that are illustrated also in FIG. 3 are identified with the same reference numbers. The receiver detector 21 is preferably a superheterodyne receiver to detect only a narrow band of rf signals, and thus eliminate much of the noise. This circuit also yields maximum reception range. This is followed by a noise gate 61 to eliminate the low-amplitude noise. The design of this element is well known, and it consists basically of paired comparators, one of which receives the output of the detector 21 the other of which receives a reference level Ref. The latter is selected below the expected level of the received coded signal pulses. The noise gate 61 clips high transients and passes only those signals above the reference level Ref to a pulse width detector 62. The latter passes only pulses which have a leading edge that is followed by a trailing edge by a predetermined pulse width, and ignores all others. The effect of this element is to filter out any high level spikes characteristic of spark ignition noise.

The pulse coded signal from the detector 62 is passed to the decoder 22 which here is in the form of a presettable pulse decoder circuit 63. This is coupled to a pair of presetting means 23A, 23B each of which is preset with a respective multi-bit binary code, one of which corresponds to a "latch" condition, the other to an "unlatch" condition. The decoder circuit 63 checks the incoming pulse coded signal against the preset codes, and if the signal matches the setting of either presetting means 23A or 23B, it transmits a "latch" (high) or "unlatch" (low) to a latch/unlatch flip flop 64. The latter is seen to constitute the "flag condition circuit" 24 of FIG. 3. The inverting output $\overline{Q}$ of the flip flop 64 is coupled to a relay 65 that controls the "green" lamp or indicator 26, while the noninverting output $\overline{Q}$ is coupled to another relay 66 that controls the "yellow" lamp or indicator 27.

Figure 9:
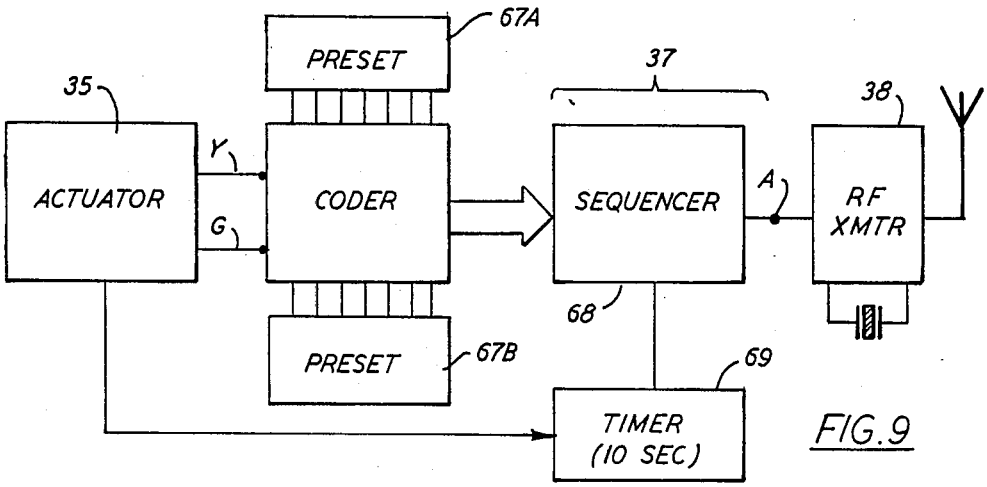

The transmitter unit 17 has corresponding circuitry as shown in FIG. 9, which produces the pulse coded rf signal. Here the actuator or selector switch 35 has "yellow" and "green" outputs Y, G that are coupled to respective inputs of the coder 36. The latter is complementary to the receiver pulse decoder 63, and has a pair of presetting means 67A, 67B coupled to it, and which are preset with the same multi-bit binary codes as the receiver presetting means 23A,23B. The transmitter's modulator 37 is generally constituted by a sequencer 68, which is controlled by a timer circuit 69, to supply the multi-bit codes to the rf transmitter 38.

Figure 10:
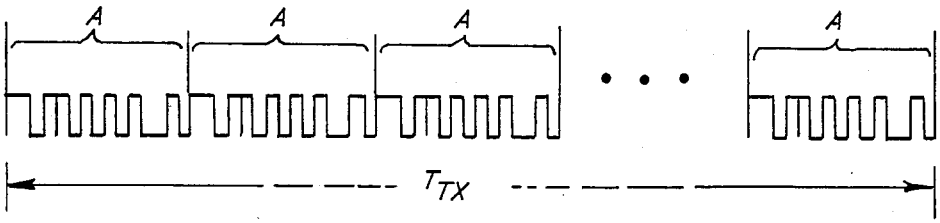
FIG. 10 shows a pulse coded signal employed with embodiments of this invention.

Here, whenever the track official actuates the switch 35, a connection therefrom starts the timer 69 which continues for a predetermined transmission period $T_{TX}$, such as ten seconds. The sequencer 68 feeds the respective preset code A (FIG. 10) which repeats over the entire transmission period $T_{TX}$, to the transmitter 38. A synchronizing bit may be included between successive repetitions. This same repeated pulse code signal A appears at the input to the pulse decoder 63 of the receiver unit.

The ten second repeated transmissions of the coded signal A (each repetition being perhaps 200 msec) ensures that the signal will reach each race car even if blocked by another vehicle or in a dip or curve on the track for part of the transmission period $T_{TX}$. The repeated transmission also compensates for the fact that engine electrical noise may distort or destroy one or more of the repetitions.

In this design, the noise gate 61 filters out low electrical noise and limits transients that could damage the decoder. The pulse width detector 62 determines whether the incoming signals have the proper width for the pulse, and eliminates all other stray noise from being considered a digital pulse. This detector discards any pulses not within predetermined parameters. Then the pulse decoder 63 determines correctness of the codes and actuates the flip flop 64 only when the code is one of the two correct preset ones. The latch/unlatch flip flop 64 will accept the latch and unlatch commands from the decoder 63 and will stay in the correct state after the end of the transmission period $T_{TX}$, i.e., until the other preset code is received.

The relays 65,66 need not be coil-type relays, but can be solid state devices. The voltage for the lights 26,27 can be supplied from the receiver unit battery 31, or from an external source, such as the race car's electrical system.

As to the power supply battery 31, it has been found that a five amp-hour, 12 volt rechargeable battery will supply sufficient power for typical racetrack activity.

The preset codes can be selected and changed as need be, by the race officials. This will help prevent sabotage by use of pirate transmitters at the track.

While the invention has been described in detail with respect to a preferred embodiment, it should be recognized that many modifications and variations thereof would present themselves to those of skill in the art without departing from the scope and spirit of this invention, as defined in the appended claims.

What is claimed is:

1. A race condition alerting system for use on a race course to signal racing conditions to all of a plurality of racing motor vehicles proceeding around a closed loop race course, in which a race official monitors race course conditions and signals one of a plurality of conditions including a yellow flag or caution condition and a green flag or safe race condition, to be observed by the operators of said racing motor vehicles with one of said conditions being in effect at any time during a race, comprising:

transmitter means transmitting a carrier which is modulated with a pulse coded racing condition signal to indicate a selected one of said conditions, including manually actuable means permitting the race official to select between said conditions according to the observed race course condition, radiating means for radiating the carrier over a range that encompasses the entire race course, an encoder that pulse encodes the modulated carrier according to an appropriate one of a plurality of preset codes corresponding to said race conditions, and timer means for supplying said pulse coded race condition signal to said radiating means for a predetermined transmission time; and a plurality of receiver units each including means for mounting in a respective one of said racing motor vehicles; antenna means to receive said carrier at all positions on said race course; a demodulator for demodulating said carrier; signal processing means following said demodulator for eliminating stray noise and passing the demodulated signal as a pulse coded signal; decoder means corresponding to the encoder of said transmitter, which includes presetting means preset with said plurality of codes corresponding to said race conditions and providing a plurality of output race course conditions signals when and only when the demodulated pulse coded signal matches an associated one of said preset codes; indicating means providing the operator with respective visible indications corresponding to at least said green flag and yellow flag conditions; and means for actuating said indicating means in accordance with said decoded output race course condition as provided from the decoder means, and maintaining the respective visible indication to the respective operator at least until another said output race course condition signal is provided thereto from said decoder means so that the operator is continuously presented with a positive visible race course condition indication at all times during the race.

2. The race condition alerting system according to claim 1, wherein said transmitter means includes means for repeating said pulse coded race condition signal a succession of times during said predetermined transmission time.

3. The race condition alerting system according to claim 2, wherein said predetermined transmission time is on the order of about ten seconds.

4. The race condition alerting system according to claim 1, wherein each said receiver unit signal processing means includes a noise gate between said demodulator and said decoder means for passing to said decoder means only signals whose amplitude exceeds a predetermined threshold.

5. The race condition alerting system according to claim 1, wherein each said receiver unit signal processing means includes a pulse width detector which passes only signals having a predetermined pulse width to said decoder means.

6. The race condition alerting system according to claim 1, wherein said means for actuating said indicating means includes at least one flip-flop having at least one input coupled to said decoder means to receive said output race condition signals, and having at least one output, and means coupling said at least one output to said indicating means to actuate the same in accordance with an output state of said flip-flop; said flip-flop being set into one state upon receiving one of said output race condition signals and into a complementary state upon receiving another one of said output race condition signals.

7. The race condition alerting system according to claim 6, wherein said flip flop latches and holds its respective state after said pulse decoder means outputs one of said race condition signals, and assumes the other of said states and holds the same when and only when said pulse decoder means outputs another of said race condition signals.

* * * * *